US008485004B2

(12) United States Patent
Kobayashi et al.

(10) Patent No.: US 8,485,004 B2
(45) Date of Patent: Jul. 16, 2013

(54) APPARATUS AND METHOD FOR FORMING LEATHER GROOVE

(75) Inventors: Seiichi Kobayashi, Shiroishi (JP); Yukihiro Murakami, Shiroishi (JP)

(73) Assignee: Midori Technopark Co., Ltd., Miyagi (JP)

( * ) Notice: Subject to any disclaimer, the term of this patent is extended or adjusted under 35 U.S.C. 154(b) by 0 days.

(21) Appl. No.: 13/499,583

(22) PCT Filed: Sep. 30, 2010

(86) PCT No.: PCT/JP2010/067071

§ 371 (c)(1),
(2), (4) Date: Mar. 30, 2012

(87) PCT Pub. No.: WO2011/040520

PCT Pub. Date: Apr. 7, 2011

(65) Prior Publication Data

US 2012/0192597 A1 Aug. 2, 2012

(30) Foreign Application Priority Data

Sep. 30, 2009 (JP) ..... 2009-227647

(51) Int. Cl.
*C14B 1/02* (2006.01)

(52) U.S. Cl.
USPC ..... 69/2; 69/9

(58) Field of Classification Search
USPC ..... 69/2, 9, 21.5; 83/875
See application file for complete search history.

(56) References Cited

U.S. PATENT DOCUMENTS

| | | | | |
|---|---|---|---|---|
| 4,151,622 | A * | 5/1979 | Mohrbach | 12/41.05 |
| 4,226,098 | A * | 10/1980 | Alexander | 69/2 |
| 5,771,586 | A * | 6/1998 | Lotarski et al. | 30/293 |
| 5,852,877 | A * | 12/1998 | Lotarski et al. | 30/290 |
| 6,152,003 | A * | 11/2000 | Jung | 83/74 |
| 7,726,159 | B2 * | 6/2010 | Gallucci | 69/2 |
| 8,033,146 | B2 * | 10/2011 | Zorzolo et al. | 69/2 |
| 2003/0010802 | A1 * | 1/2003 | Blaimschein et al. | 225/96 |
| 2008/0149003 | A1 * | 6/2008 | Gallucci | 108/50.01 |
| 2010/0043501 | A1 * | 2/2010 | Zorzolo et al. | 69/2 |
| 2010/0199827 | A1 * | 8/2010 | Colegrove | 83/651 |

FOREIGN PATENT DOCUMENTS

| | | | |
|---|---|---|---|
| JP | 10-008100 | A | 1/1998 |
| JP | 2000-351355 | A | 12/2000 |
| JP | 2007-137088 | A | 6/2007 |
| JP | 2008-104618 | A | 5/2008 |

(Continued)

OTHER PUBLICATIONS

Official Action in a counterpart Japanese Patent Application 2009-227647 dated Feb. 8, 2012.

(Continued)

*Primary Examiner* — Shaun R Hurley
(74) *Attorney, Agent, or Firm* — NDQ&M Watchstone LLP

(57) ABSTRACT

A leather groove forming apparatus includes: a blade holder 43 holding a blade 35 for forming a groove 9 in one surface in a thickness direction of a held leather 5 held in a flat sheet state; blade holder moving unit for moving the blade holder in an in-plane direction of the one surface in the thickness direction of the held leather 5; and blade holder positioning unit for positioning the blade holder 43 in a direction intersecting with the in-plane direction with the blade holder 43 placed on a guide member 55 in formation of the groove in the held leather 5 by moving the blade holder 43 using the blade holder moving unit.

7 Claims, 12 Drawing Sheets

FOREIGN PATENT DOCUMENTS

| | | | |
|---|---|---|---|
| JP | 2008-230581 | A | 10/2008 |
| JP | 2008-233054 | A | 10/2008 |
| JP | 2009-149158 | A | 7/2009 |
| JP | 2011-074243 | A | 4/2011 |

OTHER PUBLICATIONS

International Search Report in the corresponding International Patent Application No. PCT/JP2010/067071 dated Jan. 11, 2011.

English Abstract for JP 2008-104618 A, published May 8, 2008.
English Abstract for JP 2007-137088 A, published Jun. 7, 2007.
English Abstract for JP 2008-230581 A, published Oct. 2, 2008.
English Abstract for JP 2008-233054 A, published Oct. 2, 2008.
English Abstract for JP 2000-351355 A, published Dec. 19, 2000.
English Abstract for JP 10-008100 A, published Jan. 13, 1998.
English Abstract for JP 2009-149158 A, published Jul. 9, 2009.
English Abstract for JP 2011-074243 A, published Apr. 14, 2011.

* cited by examiner (a)

(b)

(a)

(b)

(a)

(b)

APPARATUS AND METHOD FOR FORMING LEATHER GROOVE

CROSS REFERENCE TO RELATED APPLICATIONS

This is the national stage of International Application No. PCT/JP2010/067071, filed Sep. 30, 2010, which application claims priority to Japanese Pat. App. No. 2009-227647, filed Sep. 30, 2009. All of the above-identified applications are incorporated herein by reference in their entireties.

TECHNICAL FIELD

The present invention relates to an apparatus and a method for forming leather grooves and, for example, relates to an apparatus and a method for forming grooves in leather for covering and decorating a horn pad of a vehicle.

BACKGROUND ART

With recent trends for luxurious interior of a vehicle, there have been an increasing number of cases where leather is used for large parts, such as a horn pad or an instrument panel equipped with an airbag therein, in addition to a leather-bound steering wheel or shift knob.

A plate-like base material for the horn pad or instrument panel is provided with slits as expected break lines. The slits allow the horn pad or instrument panel to immediately break and open when the airbag is inflated. The leather is attached to the base material with an adhesive so as to cover the front side (passenger side) of the base material, but should not prevent the horn pad or instrument panel (base material) from being broken and opened from the expected break lines.

Therefore, fragile portions need to be provided in the leather in accordance with the positions of the expected break lines in the base material. Note that, in order not to impair the sense of high quality created by the leather, the fragile portions need to be provided to be invisible to the driver or passengers of the vehicle. There has been adopted a method, for example, of making half-cut (cutting the leather while leaving a remnant of a predetermined thickness) slits (grooves), as the fragile portions, in the back side (surface to be attached to the base material) of the leather along with the expected break lines on the base material.

In the case of forming grooves in the leather, the thickness of the remnant of the leather in portions where grooves are made (portions where grooves are formed) (the remaining thickness of the leather in the groove portions) needs to have a proper and accurate value. If the remnant of the leather is too thick, the horn pad or instrument panel (base material) does not break from the expected break lines when the airbag is inflated. Thus, the leather may hinder the inflation of the airbag. On the other hand, if the remnant of the leather is too thin, lines (linear bulges or depressions of leather) indicating the positions of the grooves appear on the surface of the leather (on the side visible to a driver and the like), which impair the sense of high quality created by the leather.

To solve such a problem, there has been known an apparatus for forming a groove in leather (leather groove forming apparatus) in which a knife (blade) is attached to a head of an XY plotter (apparatus for moving a head in X-axis and Y-axis directions which are horizontal directions, by using an actuator such as a servo motor in accordance with a trajectory specified by a program). This technology is disclosed in, for example, Patent Documents 1 and 2 described below.

PRIOR ART DOCUMENTS

Patent Documents

Patent Document 1: Japanese Patent Application Laid-Open No. Hei 10-8100

Patent Document 2: Japanese Patent Application Laid-Open No. 2009-149158

DISCLOSURE OF THE INVENTION

Technical Problem

Also, using an actuator such as a servo motor, the conventional leather groove forming apparatus controls the position of the head having the knife attached thereto in a Z-axis direction (a vertical direction; a depth direction of a groove formed in leather) according to the program in order to obtain a proper and accurate remaining thickness of the leather in the groove portion.

More specifically, the conventional leather groove forming apparatus includes an X-axis movable body provided on a bed thereof (a base body on which the leather is placed), which can be freely moved and positioned in the X-axis direction by the servo motor or the like, a Y-axis movable body provided on the X-axis movable body, which can be freely moved and positioned in the Y-axis direction by the servo motor or the like, and a head provided on the Y-axis movable body, which can be freely moved and positioned in the Z-axis direction by the servo motor or the like. With this configuration, the apparatus forms a groove in the leather by moving the blade (head) in the X-axis, Y-axis and Z-axis directions according to the program.

Thus, formation of grooves in the leather has problems that the thickness of a remnant of the leather in the groove portion is inaccurate because of, for example, an inaccurate position of the head in the Z-axis direction due to elastic deformation of a beam of the X-axis movable body having the elongated shape, and an inaccurate position of the head in the Z-axis direction due to very slight rattling (backlash) of the X-axis movable body and the Y-axis movable body.

Note that it is also conceivable to correct the position of the head in the Z-axis direction in accordance with the position of the head in the X-axis or Y-axis direction, in order to avoid such an inaccurate thickness of the remnant of the leather. However, there is a problem that such corrections complicate the configuration of the apparatus or operation programs.

The present invention was made in consideration of the foregoing problems. It is an object of the present invention to provide a leather groove forming apparatus and a leather groove forming method for forming grooves in one surface in a thickness direction of leather, which are capable of obtaining an accurate thickness of a remnant of the leather in a portion where a groove is formed without complicating a configuration of the apparatus or operation programs.

Technical Solution

A first aspect of the present invention to achieve the foregoing object is a leather groove forming apparatus including: a blade holder holding a blade for forming a groove in one surface in a thickness direction of a held leather held in a flat sheet state; blade holder moving unit for moving the blade holder in an in-plane direction of the one surface in the thickness direction of the held leather; and blade holder positioning unit for positioning the blade holder in a direction intersecting with the in-plane direction with the blade holder placed on a guide member during formation of the groove in the held leather by moving the blade holder using the blade holder moving unit.

A second aspect of the present invention according to the first aspect is the leather groove forming apparatus, in which the groove includes a first portion and a second portion intersecting with the first portion or a second portion forming a "T"-shaped portion with the first portion, and the guide member includes a first guide member on which a roller of the blade holder is placed in formation of the first portion, and a second guide member on which the roller of the blade holder is placed in formation of the second portion.

A third aspect of the present invention according to one of the first and second aspects is the leather groove forming apparatus, in which the groove is formed in an "H" shape, including an approximately horizontally extending horizontal portion, an approximately vertically extending first vertical portion having an intermediate portion in its longitudinal direction intersect with one end in a longitudinal direction of the horizontal portion, and an approximately vertically extending second vertical portion having an intermediate portion in its longitudinal direction intersect with the other end in the longitudinal direction of the horizontal portion, the one end in the longitudinal direction of the horizontal portion slightly protrudes outward from the first vertical portion, the other end in the longitudinal direction of the horizontal portion slightly protrudes outward from the second vertical portion, and the guide member includes a first guide member on which a roller of the blade holder is placed in formation of the vertical portions, and a second guide member on which the roller of the blade holder is placed in formation of the horizontal portion.

A fourth aspect of the present invention is a leather groove forming apparatus including: a base body integrally holding the leather with a leather retainer, the leather being held integrally with the leather retainer in a flat sheet state, with the other surface in the thickness direction being in surface contact with a planar holding surface of the leather retainer; an X-axis movable body provided on the base body movably in an X-axis direction that is one horizontal direction; a Y-axis movable body provided on the X-axis movable body movably in a Y-axis direction that is another horizontal direction orthogonal to the X-axis direction; a blade holder provided on the Y-axis movable body movably in a vertical direction and configured to hold a blade for forming a groove in the held leather; an X-axis drive unit for driving the X-axis movable body in the X-axis direction; a Y-axis drive unit for driving the Y-axis movable body in the Y-axis direction; and a roller rotatably provided in the blade holder and configured to position the blade holder in the vertical direction with an outer periphery of the roller placed on a guide member provided in the leather retainer.

A fifth aspect of the present invention according to the fourth aspect is the leather groove forming apparatus, in which the groove includes a first portion and a second portion intersecting with the first portion or a second portion forming a "T"-shaped portion with the first portion, and the guide member includes a first guide member on which a roller of the blade holder is placed in formation of the first portion, and a second guide member on which the roller of the blade holder is placed in formation of the second portion.

A sixth aspect of the present invention according to one of the fourth and fifth aspects is the leather groove forming apparatus, in which the groove is formed in an "H" shape, including an approximately horizontally extending horizontal portion, an approximately vertically extending first vertical portion having an intermediate portion in its longitudinal direction intersect with one end in a longitudinal direction of the horizontal portion, and an approximately vertically extending second vertical portion having an intermediate portion in its longitudinal direction intersect with the other end in the longitudinal direction of the horizontal portion, the one end in the longitudinal direction of the horizontal portion slightly protrudes outward from the first vertical portion, the other end in the longitudinal direction of the horizontal portion slightly protrudes outward from the second vertical portion, and the guide member includes a first guide member on which a roller of the blade holder is placed in formation of the vertical portions, and a second guide member on which the roller of the blade holder is placed in formation of the horizontal portion.

A seventh aspect of the present invention is a leather groove forming method for forming a groove in leather using the leather groove forming apparatus according to any one of the first to sixth aspects.

An eighth aspect of the present invention is a leather groove forming method including: a leather holding step of holding leather in a flat sheet state; and a groove forming step of forming a groove in one surface in a thickness direction of the leather, held in the flat sheet state in the leather holding step, with a blade for forming a groove in the leather or a blade holder holding the blade placed on a guide member so that a remnant of the leather where the groove is formed in the leather has an approximately constant thickness.

Advantageous Effects

The present invention according to the first to eighth aspects described above achieves an effect that, in a leather groove forming apparatus and a leather groove forming method for forming grooves in one surface in a thickness direction of leather, an accurate thickness of a remnant of the leather in portions where grooves are formed can be obtained without complicating a configuration of the apparatus or operation programs.

BEST MODES FOR CARRYING OUT THE INVENTION

With reference to the drawings, embodiments of the present invention are described below.

Figure 1:
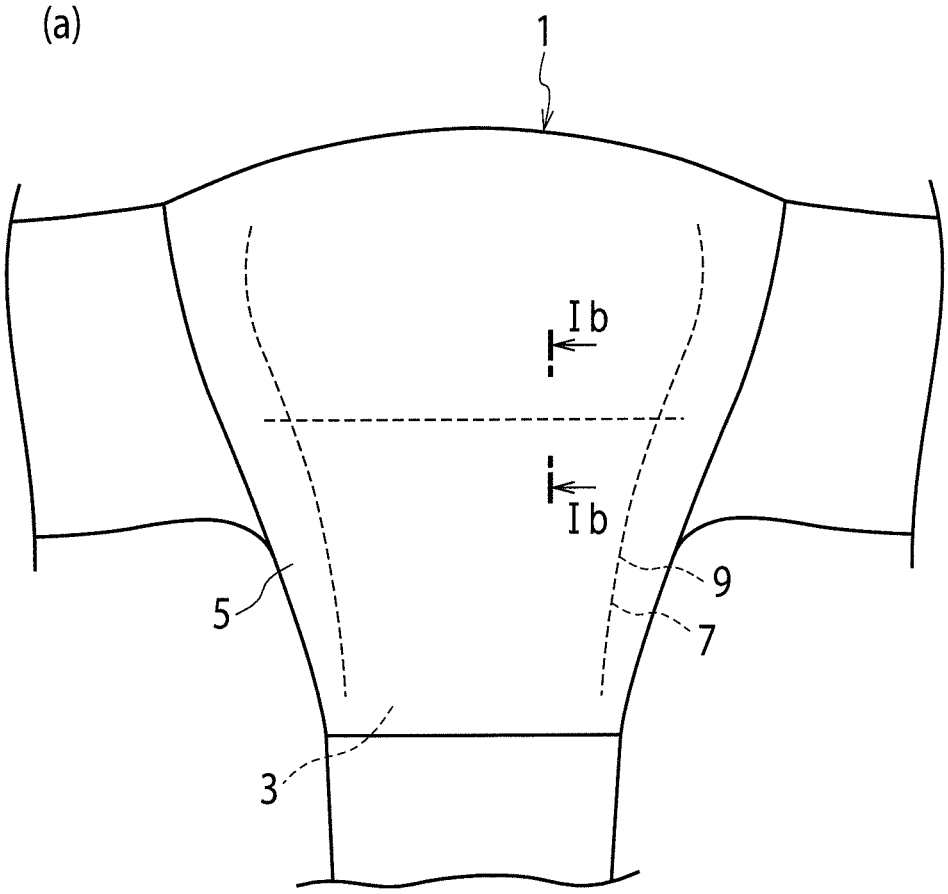
FIGS. 1 (*a*) and 1 (*b*) are views showing a schematic configuration of a horn pad used in a steering of a vehicle.
Figure 1:
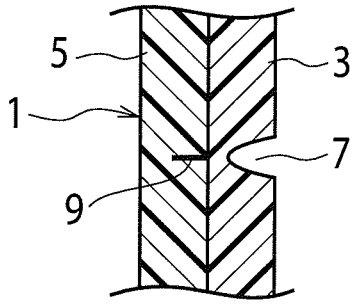

FIGS. 1 (*a*) and 1 (*b*) are views showing a schematic configuration of a horn pad 1 used in a steering of a vehicle. FIG. 1 (*a*) is a front view of the horn pad 1, and FIG. 1 (*b*) is a cross-sectional view taken along the line Ib-Ib of FIG. 1 (*a*).

The horn pad 1 is provided in the center of a steering wheel of the vehicle. An airbag unit (airbag) is provided behind the horn pad 1 shown in FIG. 1 (*a*) (on the back side of the page space of FIG. 1 (*a*)).

The horn pad 1 includes a base material 3 and a leather (e.g., natural leather such as cowhide) 5 attached to the base material 3 with a glue or adhesive. The base material 3 is formed into a sheet that is not flat but curved. In one surface of the base material 3 in its thickness direction (a surface on the side opposite to a driver of the vehicle), a "V"-shaped groove (expected break line) 7, for example, is formed in an extending manner.

In one surface of the leather 5 in its thickness direction, a groove (fragile portion) 9 is formed in an extending manner. The leather 5 is provided to cover the surface of the base material 3. The groove 7 in the base material 3 and the groove 9 in the leather 5 overlap with each other as shown in FIG. 1 (*a*) when viewed from the thickness direction of the leather 5 and the base material 3.

When the airbag is inflated, the horn pad 1 immediately breaks to be cleaved at the respective grooves 7 and 9. Note that the groove 9 is formed in a floor surface of the leather 5. In the horn pad 1, the floor surface of the leather 5 is in contact with the base material 3, and the grain side of the leather 5 faces the driver.

The floor surface and grain side of the leather 5 are described. Considering cow skin, for example, as the leather, the grain side means the surface skin side while the floor surface means the flesh side. Moreover, fiber components constituting the leather are dense on the grain side, and are rough on the floor surface side. Thus, mechanical strength such as tensile strength is high on the grain side, and is low on the floor surface side.

Figure 3:
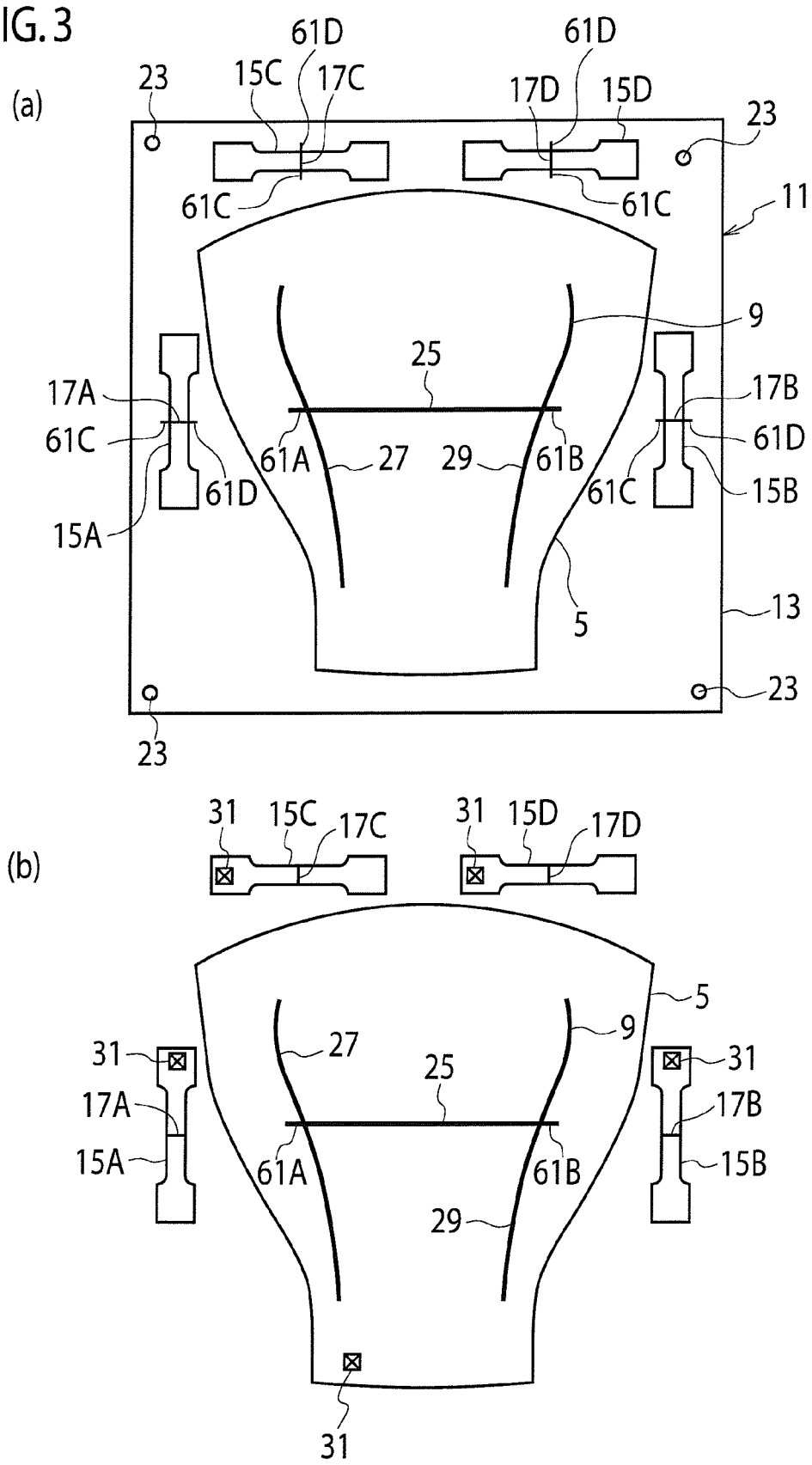
FIGS. 3 (*a*) and 3 (*b*) are views showing production of a leather and test pieces out of the small piece of leather material.

FIGS. 3 (*a*) and 3 (*b*) are views showing production of the leather 5 and test pieces 15 out of a small piece of leather material 11.

Figure 2:
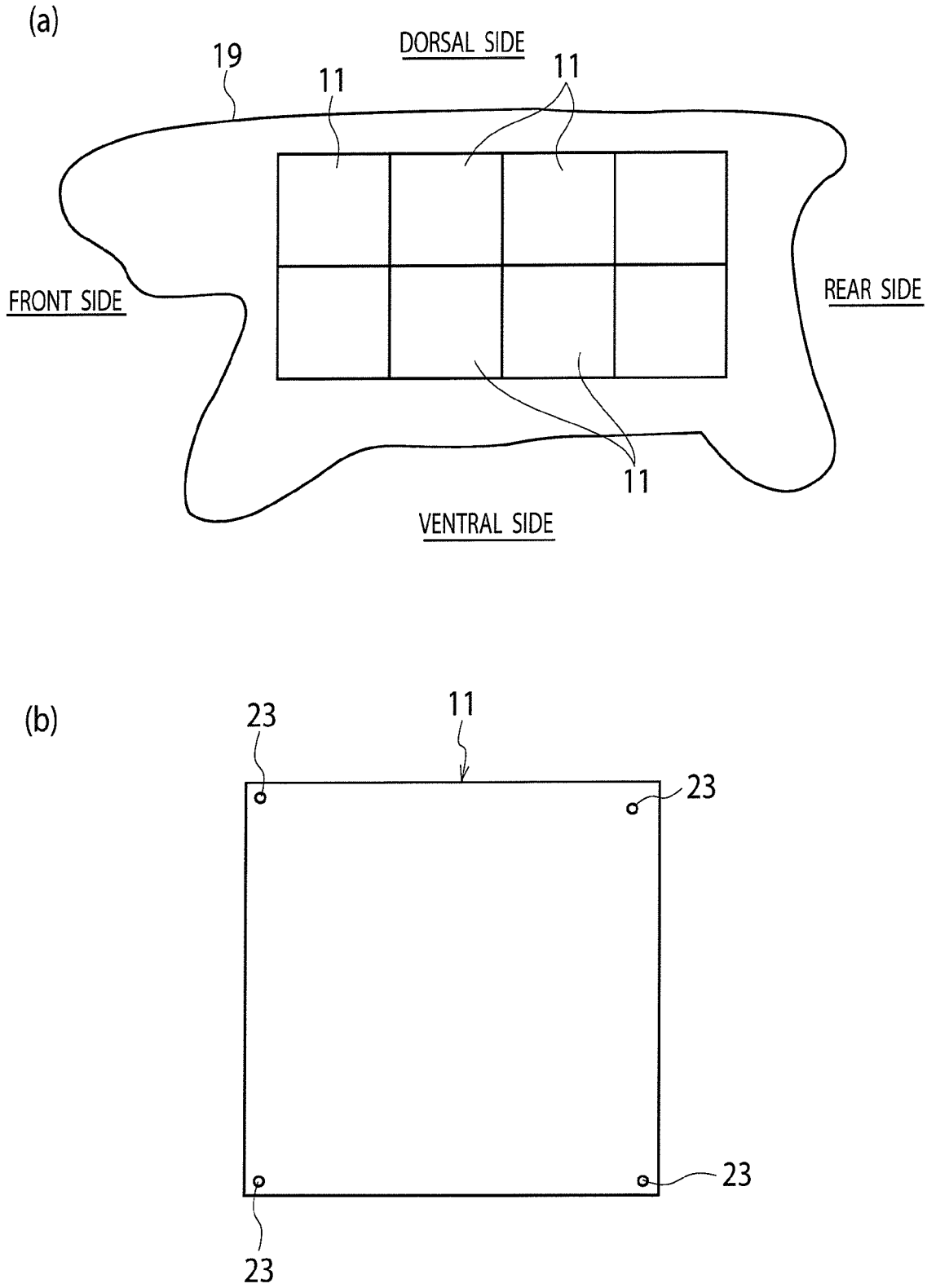
FIGS. 2 (*a*) and 2 (*b*) are views showing production of small pieces of leather material out of one large piece of leather material.

The leather 5 is produced by punching the small piece of leather material 11 (see FIG. 2 (*b*)) using a die (not shown), for example. Note that FIG. 3 (*a*) shows a state immediately after the leather 5 is punched out of the small piece of leather material 11. FIG. 3 (*a*) also shows a remaining portion 13 of the small piece of leather material 11. FIG. 3 (*b*) shows a state where the leather 5 is punched out of the small piece of leather material 11 and the remaining portion 13 is removed. Moreover, four test pieces (dumbbells) 15 (15A, 15B, 15C and 15D) are produced at the same time as one piece of leather 5 from one small piece of leather material 11 by punching using the die described above. The four test pieces 15 are formed, for example, around the leather 5.

The groove 9 is formed in the leather 5, and grooves 17 (17A, 17B, 17C and 17D) similar to the groove 9 are also formed in the test pieces 15. The grooves 9 and 17 are formed in the floor surface of the small piece of leather material 11 (the leather 5 and test pieces 15). The remnant of the small piece of leather material 11 having the groove 9 formed therein has a constant thickness, and the remnant of the small piece of leather material 11 having the grooves 17 formed therein also has a constant thickness, which is the same as the thickness of the remnant of the small piece of leather material 11 having the groove 9 formed therein.

Note that the test piece 15A is formed in a vertically elongated shape, and the groove 17A is formed extending horizontally in the center of a longitudinal direction of the test piece 15A. Similarly, the test piece 15B is formed in a vertically elongated shape, and the groove 17B is formed extending horizontally in the center of a longitudinal direction of the test piece 15B. The test piece 15C is formed in a horizontally elongated shape, and the groove 17C is formed extending vertically in the center of a longitudinal direction of the test piece 15C. Similarly, the test piece 15D is formed in a horizontally elongated shape, and the groove 17D is formed extending vertically in the center of a longitudinal direction of the test piece 15D.

The reason why the test pieces 15A and 15B are formed in the vertically elongated shape and the test pieces 15C and 15D are formed in the horizontally elongated shape is because the strength of the small piece of leather material 11 may vary between the vertical and horizontal directions since the properties (tensile and tear strength) of natural leather significantly vary depending on individuals, sites and collection directions. Thus, the reason why the test pieces are formed in the shapes described above is to assure that the leather 5 surely breaks at the groove 9 even when the formation direction of the groove 9 (the longitudinal direction of the groove 9) varies.

Here, the production process of the leather 5 and the test pieces 15 is described in more detail.

Figure 4:
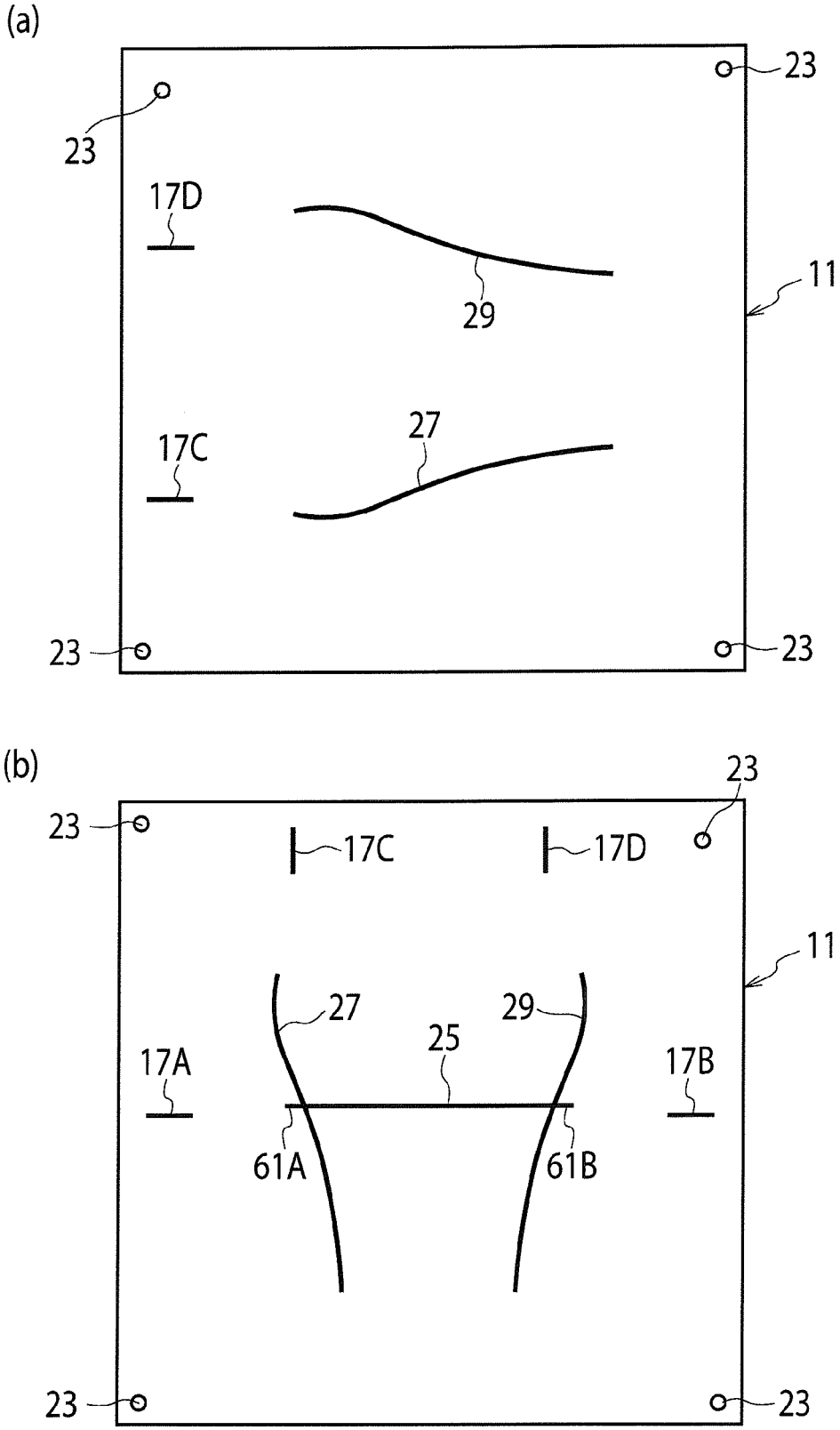
FIGS. 4 (*a*) and 4 (*b*) are views showing formation of grooves in the small piece of leather material.

FIGS. 2 (*a*) and 2 (*b*) are views showing production of small pieces of leather material 11 out of one large piece of leather material 19. FIGS. 4 (*a*) and 4 (*b*) are views showing formation of grooves 27, 29 and 17 in the small piece of leather material 11.

First, as shown in FIG. 2 (*a*), the small pieces of leather material 11 are produced by being cut out of the one large piece of leather material 19. Note that the large piece of leather material 19 is subjected to pretreatment such as dehairing and tanning.

In the small piece of leather material 11, notches (not shown) or circular through-holes 23 are formed to determine the posture and position of the small piece of leather material 11 during formation of the grooves 9 (27 and 29) and 17 in the small piece of leather material 11 or punching of the small piece of leather material 11 using the die described above (see FIG. 2 (*b*)).

Thereafter, as shown in FIGS. 4 (*a*) and 4 (*b*), the grooves 27 and 29 in the leather 5 and the grooves 17 in the test pieces 15 are formed in the small piece of leather material 11. Note that the groove 9 in the leather 5 includes a horizontal portion (horizontal slit) 25 extending approximately in the horizontal direction, a first vertical portion (first vertical slit) 27 extending approximately in the vertical direction, and a second vertical portion (second vertical slit) 29 extending approximately in the vertical direction. Moreover, an intermediate portion in the longitudinal direction of the first vertical portion 27 intersects with a portion at one end in the longitudinal direction of the horizontal portion 25, while an intermediate portion in the longitudinal direction of the second vertical portion 29 intersects with a portion at the other end in the longitudinal direction of the horizontal portion 25. In this way, the groove 9 is formed into an "H" shape.

Next, a more detailed description is given of the case where the groove 9 in the leather 5 and the grooves 17 in the test pieces 15 are formed in the small piece of leather material 11. First, as shown in FIG. 4 (*a*), the grooves 17C and 17D in the test pieces 15C and 15D and the vertical portions 27 and 29 of the leather groove 9 are formed. Then, as shown in FIG. 4 (*b*), the grooves 17A and 17B in the test pieces 15A and 15B and the horizontal portion of the leather groove 9 are formed.

Subsequently, as shown in FIG. 3 (*a*), the leather 5 and the test pieces 15 are produced by punching the small piece of leather material 11 using the die described above. Then, identification codes such as QR traceability code labels or prints 31 are given to the leather 5 and test pieces 15, respectively (see FIG. 3 (*b*)).

Thereafter, a thickness of the remnant of the test piece 15A in the portion where the groove 17A is formed is measured using a measuring device disclosed in Japanese Patent Application Publication No. 2008-233054, for example. A value obtained by the measurement is stored (kept) in a computer memory, for example, in association with the QR code 31 together with the production date of the small piece of leather material 11 (leather 5 and test pieces 15). Similarly, thicknesses of the remnants of the other test pieces 15B to 15D are also measured, and values obtained are kept in association with the QR codes 31.

Furthermore, as to the test piece 15A and test piece 15C, a tensile force when the test piece 15A breaks at the groove 17A (tensile force in the longitudinal direction of the test piece 15A) and a tensile force when the test piece 15C breaks at the groove 17C (tensile force in the longitudinal direction of the test piece 15C) are measured using a tensile testing machine (not shown). Then, values obtained by the measurement are stored (kept) in the computer memory, for example, in association with the QR codes 31.

Note that a thickness of the remnant in the groove 9 (at least any one of the portions 25, 27 and 29) of the leather 5 is not measured. However, the thickness of the remnant in the groove 9 of the leather 5 may be kept in association with the QR code 31.

Moreover, as to the order of forming the grooves 9 and 17, the groove 17A of the test piece 15A and the groove 17B of the test piece 15B are first formed, and then the respective vertical portions 27 and 29 of the groove 9 in the leather 5 are formed. Thereafter, the horizontal portion 25 of the groove 9 in the leather 5 is formed, and then the groove 17 of the test piece 15C and the groove 17D of the test piece 15D are formed. In this way, in case of breakage or the like of a blade 35 used in a leather groove forming apparatus 33 described in detail later, problems caused by the breakage or the like can be surely detected by measuring the thickness of the remnant of each groove 17.

The leather 5 thus formed is attached to the base material 3 with a glue or adhesive to produce the horn pad 1. The test piece 15B and the test piece 15D are kept to guarantee the quality of the leather 5 (particularly, the quality related to the groove 9) over a long period of time. Note that the test pieces 15A and 15C broken by the tensile test may be kept, and the remaining portion 13 of the small piece of leather material 11 may also be kept with a QR code 31 attached thereto.

While the above description has been given by taking the leather 5 and test pieces 15 used for the horn pad 1 as an example, the leather 5 and the like may be adopted for an airbag cover such as an instrument panel having an airbag.

Next, the leather groove forming apparatus 33 is described in detail.

Figure 5:
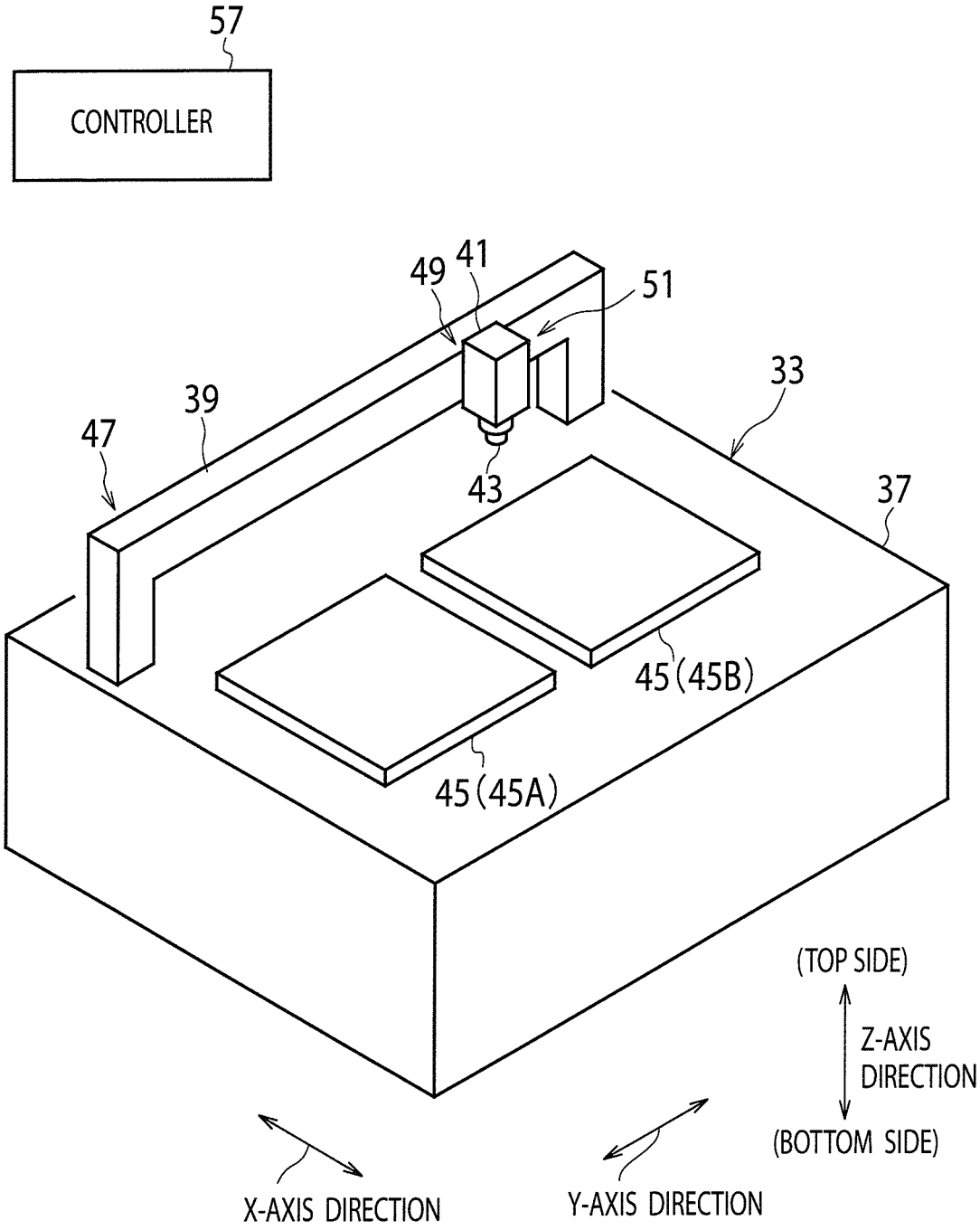
FIG. 5 is a perspective view showing a schematic configuration of a leather groove forming apparatus.
Figure 6:
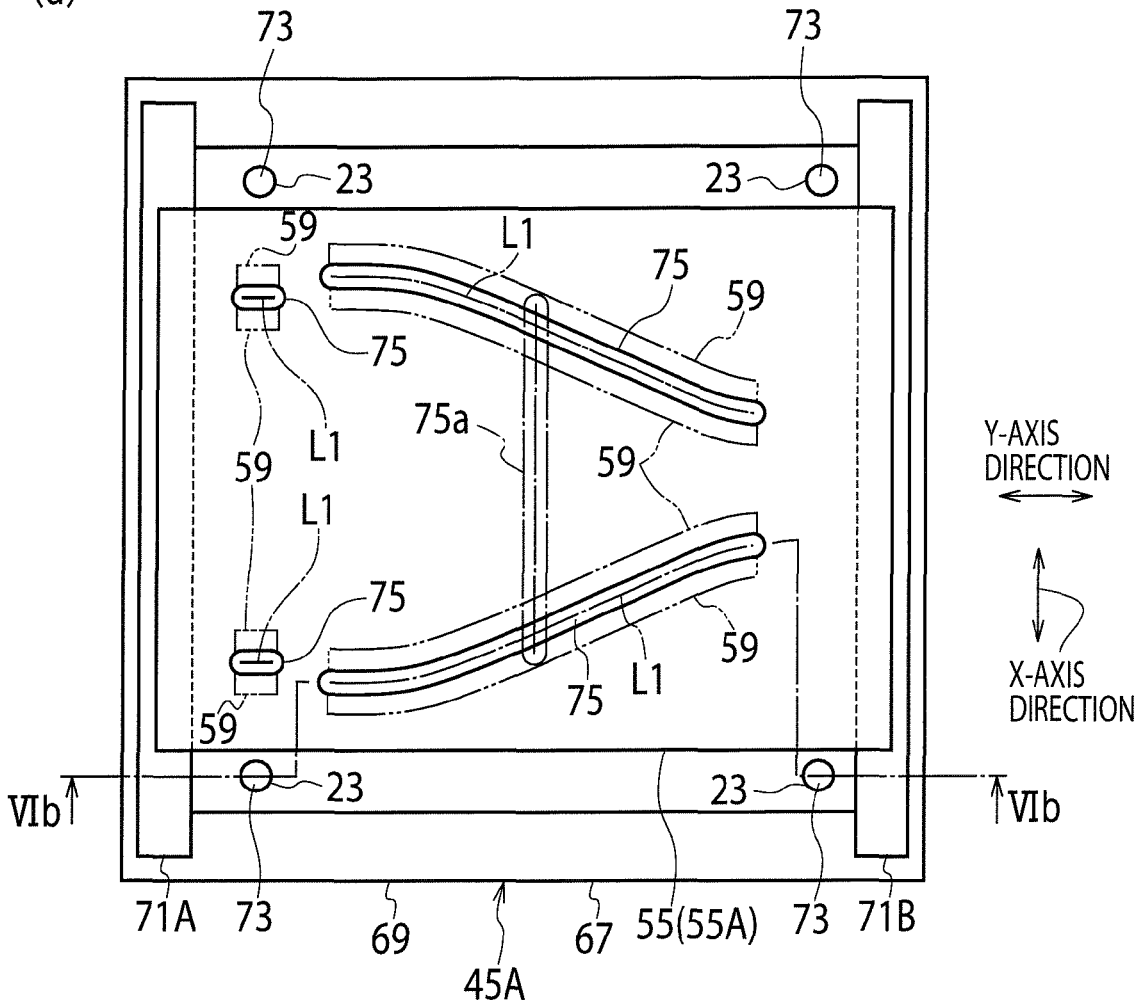
FIGS. 6 (*a*) and 6 (*b*) are views showing a schematic configuration of a first leather retainer.
Figure 6:
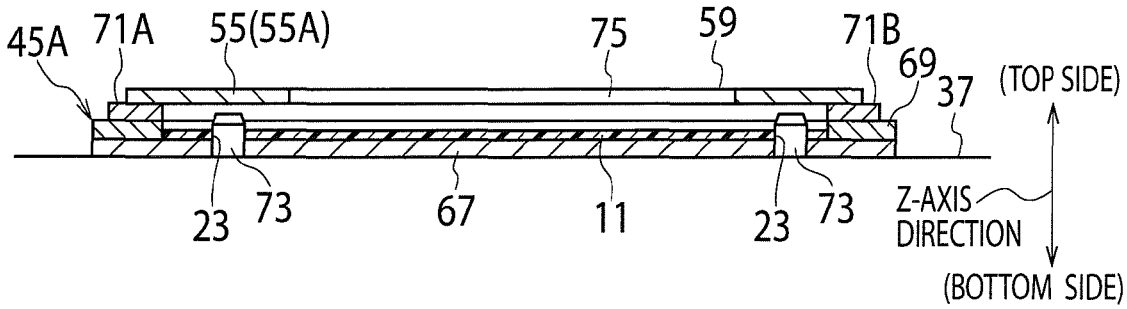
Figure 7:
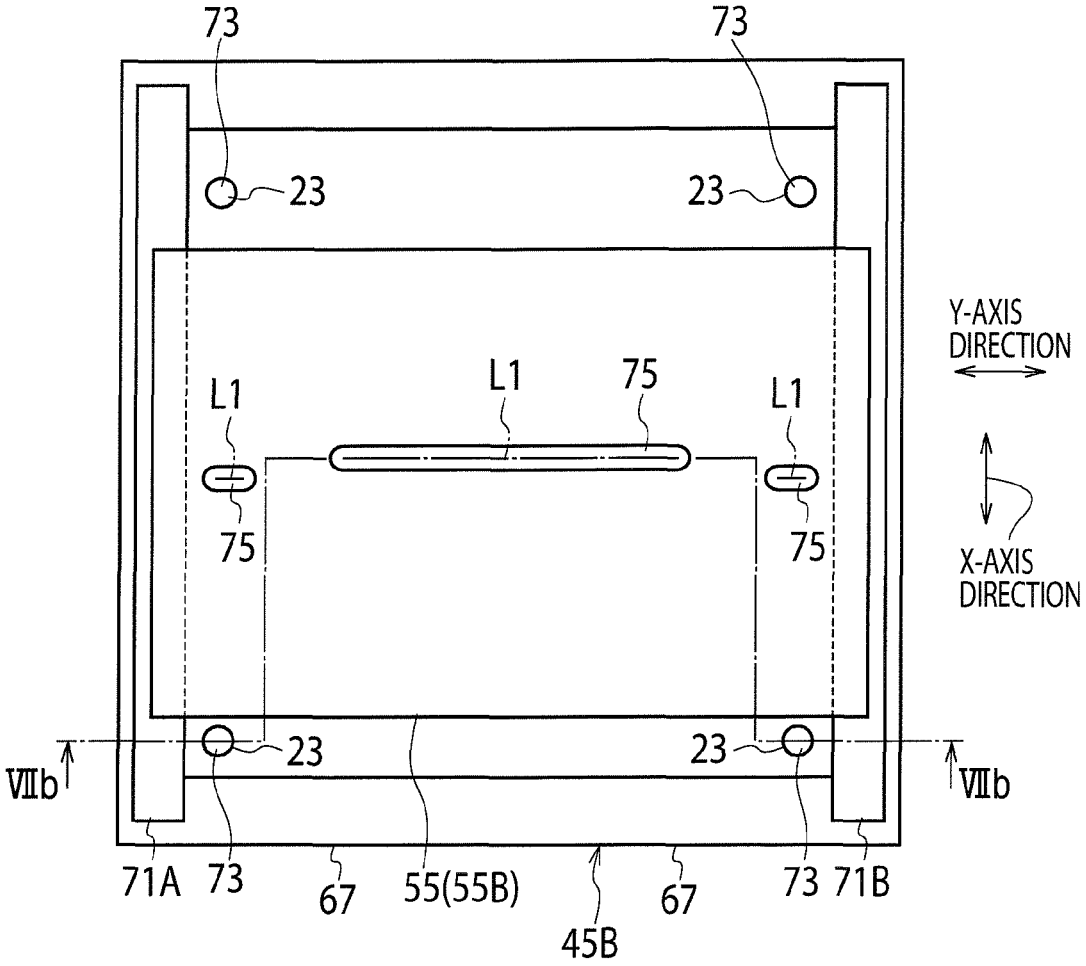
FIGS. 7 (*a*) and 7 (*b*) are views showing a schematic configuration of a second leather retainer.
Figure 7:
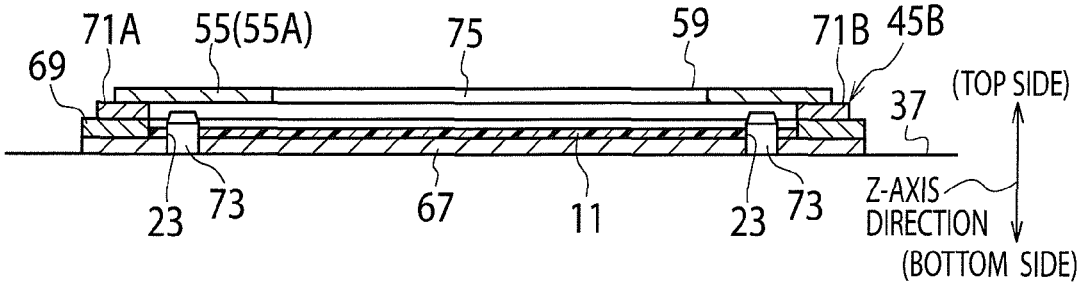

FIG. 5 is a perspective view showing a schematic configuration of the leather groove forming apparatus 33. FIGS. 6 (*a*) and 6 (*b*) are views showing a schematic configuration of a first leather retainer 45A. FIG. 6 (*a*) is a plan view of the first leather retainer 45A, and FIG. 6 (*b*) is a cross-sectional view taken along the line VIb-VIb of FIG. 6 (*a*). FIGS. 7 (*a*) and 7 (*b*) are views showing a schematic configuration of a second leather retainer 45B. FIG. 7 (*a*) is a plan view of the second leather retainer 45B, and FIG. 7 (*b*) is a cross-sectional view taken along the line VIIb-VIIb of FIG. 7 (*a*).

The leather groove forming apparatus (slit forming apparatus) 33 is for forming the grooves 9 and 17 in one surface (e.g., the floor surface) in the thickness direction of the leather 5 (small piece of leather material 11). The leather groove forming apparatus 33 includes a base body (bed) 37, an X-axis movable body 39, a Y-axis movable body 41 and a blade holder 43.

The base body 37 is formed to have a rectangular parallelepiped shape, and is configured to integrally hold the leather 5 by means of the leather retainers (small piece of leather material retainers) 45 (45A and 45B), the leather 5 being integrally held by the leather retainers 45 (45A and 45B). The thickness direction of the leather 5 (small piece of leather material 11) integrally held by the base body 37 corresponds to the vertical direction (vertical direction: Z-axis direction).

Specifically, the other surface (e.g., the grain side) in the thickness direction of the small piece of leather material 11 is in surface contact with planar holding surfaces of the leather retainers 45, and thus the small piece of leather material 11 is integrally held by the leather retainers 45 in the form of a flat plate by vacuum contact, for example. Moreover, one surface (floor surface) of the held small piece of leather material 11 serves as an upper surface, and the other surface (grain side) serves as a lower surface. The leather retainers 45 are integrally held on a planar upper surface of the base body 37 with fasteners such as bolts. In this way, the held small piece of leather material 11 is integrally held on the base body 37.

The X-axis movable body 39 is provided on the base body 37 by means of a linear guide bearing (not shown), and is movable relative to the base body 37 in the X-axis direction that is one horizontal direction. The Y-axis movable body 41 is provided on the X-axis movable body 39 by means of a linear guide bearing (not shown), and is movable relative to the X-axis movable body 39 in the Y-axis direction that is another horizontal direction and is orthogonal to the X-axis direction.

The blade holder 43 is for holding the blade 35 for forming the grooves 9 and 17 in the held small piece of leather material 11 (the held leather 5). The blade holder 43 is provided on the Y-axis movable body 41 movably in the vertical direction (Z-axis direction that is the direction orthogonal to the X-axis direction and Y-axis direction). The blade 35 is for forming the grooves 9 and 17 (slit-like grooves; very narrow and appropriately deep grooves) in the upper surface of the held small piece of leather material 11.

Note that the Y-axis movable body 41, the blade holder 43 and the blade 35 held by the blade holder 43 are positioned above the held small piece of leather material 11. The blade 35 held by the blade holder 43 protrudes downward from the blade holder 43, and makes appropriately deep slits in one surface (upper surface) in the thickness direction of the small piece of leather material 11 to form the grooves 9 and 17.

Moreover, the leather groove forming apparatus 33 is also provided with X-axis drive unit 47, Y-axis drive unit 49 and energizing means 51.

The X-axis drive unit 47 is means for driving (moving and positioning) the X-axis movable body 39 in the X-axis direction, and carries out the driving operation using an actuator such as a linear motor (not shown). The Y-axis drive unit 49 is means for driving (moving and positioning) the Y-axis movable body 41 in the Y-axis direction, and carries out the driving operation using an actuator such as a linear motor (not shown).

The energizing means 51 is means for energizing the blade holder 43 in a direction approaching the held small piece of leather material 11 (the held leather 5) (downward) relative to the Y-axis movable body 41, and carries out the energizing operation using an elastic body, for example. Note that the energizing means 51 may be realized using gravity. That is, the mass of the blade holder 43 may be increased to energize the blade holder 43 and the blade 35 downward.

Figure 8:
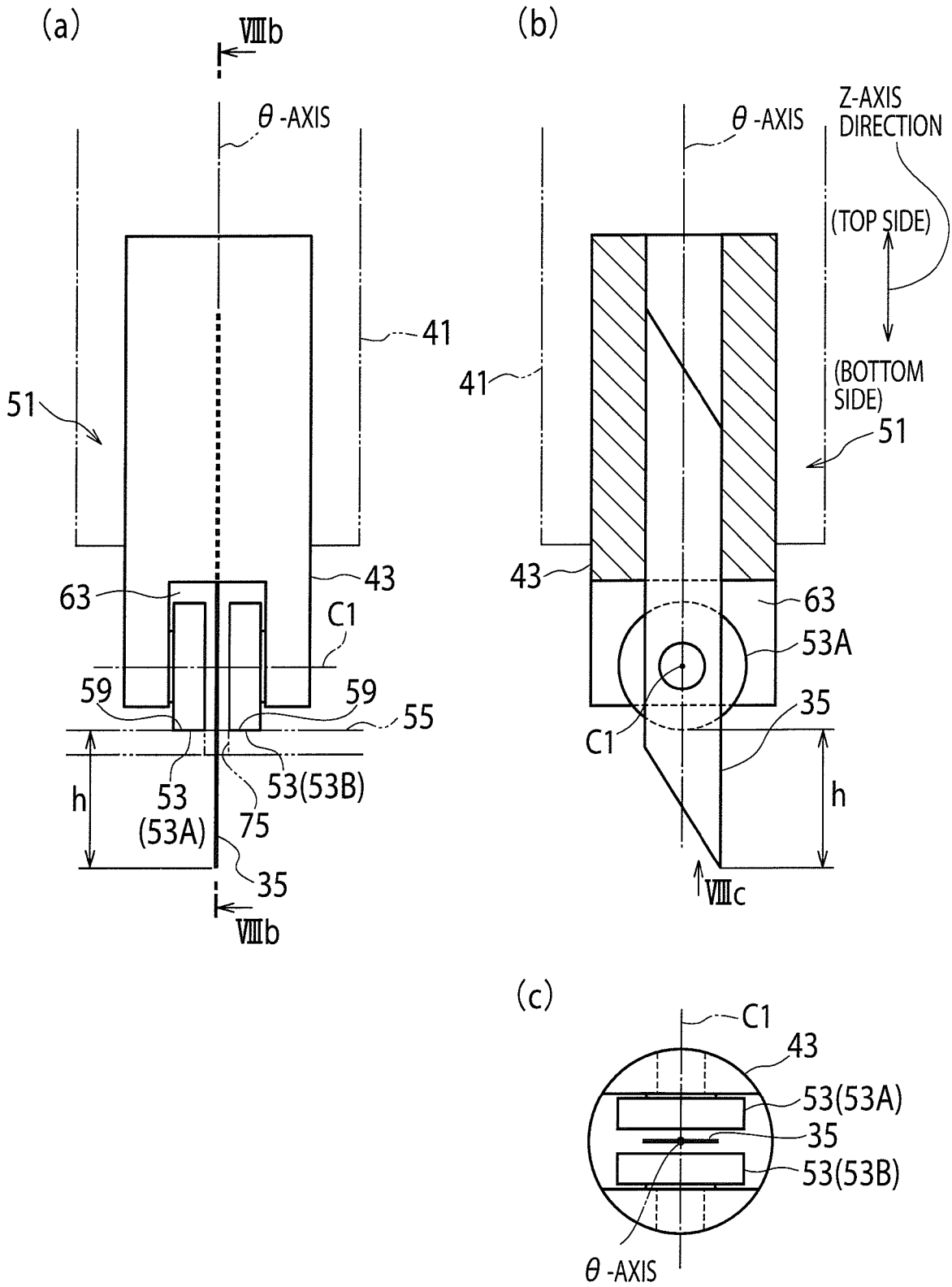
FIGS. 8 (*a*) to 8 (*c*) are views showing a schematic configuration of a blade and a blade holder holding the blade.

Moreover, the blade holder 43 is also provided with rotatable cylindrical rollers 53 (53A and 53B) (see FIGS. 8 (*a*) to 8 (c)). When the blade holder 43 is energized by the energizing means 51, peripheries (lower ends as a part of the peripheries) of the rollers 53 come into contact with a guide member 55 (55A and 55B) (see FIGS. 6, 8 and 11). More specifically, the roller 53A positioned on one side of the blade 35 held by the blade holder 43 comes into contact with a guide part 59 located on one side of a through-hole 75 of the guide member 55, and the roller 53B positioned on the other side of the blade 35 held by the blade holder 43 comes into contact with a guide part 59 located on the other side of the through-hole 75 of the guide member 55. Thus, the position of the blade holder 43 in a height direction (in the vertical direction and X-axis direction) is determined.

Note that the X-axis drive unit 47 and the Y-axis drive unit constitute blade holder moving unit. Moreover, the energizing means 51 also serves as blade holder positioning unit.

In formation of the grooves 9 and 17 using the blade 35 held by the blade holder 43, the remnant of the leather (small piece of leather material 11) in the portions where the grooves 9 and 17 are formed has a constant thickness.

Note that the cylindrical rollers 53 (53A and 53B) are provided in the blade holder 43 so as to rotate around the central axis C1 extending in the horizontal direction. When the blade holder 43 and the blade 35 are moved in the X-axis direction or the Y-axis direction to form the grooves 9 and 17, the rollers form a rolling pair relative to the guide member 55 (55A and 55B).

The leather groove forming apparatus 33 is also provided with a controller 57. The X-axis movable body 39 and the Y-axis movable body 41 are moved in accordance with the shape of the grooves 9 and 17 to be formed, under the control of the controller 57. More specifically, the controller 57 controls the X-axis drive unit 47 and the Y-axis drive unit 49, and the X-axis movable body 39 and the Y-axis movable body 41 are moved to form the grooves 9 and 17 with the rollers 53 placed on the guide part 59 (see FIG. 6 (*a*)) of the guide member 55. Thus, the small piece of leather material 11 is cut by the blade 35 to form the grooves 9 and 17.

Since the groove 9 is formed in the "H" shape, the groove 9 includes a first portion (the horizontal portion 25) and a second portion (the vertical portions 27 and 29) intersecting with the first portion or a second portion (the vertical portions 27 and 29) forming a "T"-shaped portion with the first portion.

The leather retainer 45 includes the first leather retainer 45A holding the leather 5 (small piece of leather material 11) during formation of the vertical portions 27 and 29 and the grooves 17C and 17D (see FIGS. 6 (*a*) and 6 (*b*)) and the second leather retainer 45B (different from the first leather retainer) holding the small piece of leather material 11 during formation of the horizontal portion 25 and the grooves 17A and 17B (see FIGS. 7 (*a*) and 7 (*b*)).

The guide member 55 includes a first guide member 55A and a second guide member 55B. The first guide member 55A is provided integrally with the leather retainer 45A. The rollers 53 of the blade holder 43 are placed on the first guide member 55A during formation of the vertical portions 27 and 29 of the groove 9 and the grooves 17C and 17D. Meanwhile, the second guide member 55B is provided integrally with the leather retainer 45B. The rollers 53 of the blade holder 43 are placed on the second guide member 55B during formation of the horizontal portion 25 of the groove 9 and the grooves 17A and 17B.

Moreover, as described above, the groove 9 is formed in the "H" shape including the horizontal portion 25, the first vertical portion 27 and the second vertical portion 29, and one end in the longitudinal direction of the horizontal portion 25 slightly protrudes outward from the first vertical portion 27 (outside of the H shape; to the side opposite to the second vertical portion 29 with the first vertical portion 27 in the middle). Thus, a protrusion 61A (see FIG. 4 (*b*)) is formed. Similarly, the other end in the longitudinal direction of the horizontal portion 25 slightly protrudes outward from the second vertical portion 29 (outside of the H shape; to the side opposite to the first vertical portion 27 with the second vertical portion 29 in the middle). Thus, a protrusion 61B (see FIG. 4 (*b*)) is formed.

Next, description is given of the reason why the protrusions 61A and 61B slightly protrude to the outside of the H shape. On the small piece of leather material 11 side (lower portion; tip), the blade 35 has a triangular sharp cutting edge having a slope as shown in FIG. 8 (*b*) to reduce cutting frictions.

Thus, when the horizontal portion 25 of the groove 9 is formed without the protrusions 61A and 61B provided, the deepest portion (portion at a depth t3 in FIG. 11) of the horizontal portion 25 of the groove 9 does not reach the vertical portions 27 and 29 of the groove 9. For this reason, the leather 5 does not break from the expected break line when the airbag is inflated, which may hinder the inflation of the airbag.

The reason why the protrusions are provided is also to assure the connection between the deepest portion of the horizontal portion 25 of the groove 9 and the deepest portions (portions at a depth t3 in FIG. 11) of the vertical portions 27 and 29 of the groove 9. More specifically, when the horizontal portion 25 of the groove 9 is formed from the left to the right (from the protrusion 61A to the protrusion 61B), the end portion (left end) of the protrusion 61A is at the depth t3 (the thickness of the remnant is t) even though the tip of the blade 35 is formed in a triangular shape. Therefore, it can also be considered that the protrusion 61A is not necessary even though the protrusion 61B is necessary. However, it is difficult to form the horizontal portion 25 while allowing the left end of the horizontal portion 25 of the groove 9 without the protrusion 61A to fit perfectly with the vertical portion 27 of the groove 9. For this reason, the protrusion 61A is provided to assure the connection between the deepest portion of the horizontal portion 25 of the groove 9 and the deepest portion of the vertical portion 27 of the groove 9.

Note that the protrusion 61B also assures the connection between the deepest portion of the horizontal portion 25 of the groove 9 and the deepest portion of the vertical portion 29 of the groove 9. As for the groove 17 of the test piece 15, protrusions 61C and 61D are formed (see FIG. 3 (*a*)) for approximately the same purpose as that described above (purpose of forming the deepest portion of the groove 17 across the entire width of the test piece 15).

The guide part 59 of the guide member 55, on which the rollers 53 is placed, is formed to have a shape corresponding to the shapes of the grooves 9 and 17 to be formed. Specifically, the guide part 59 is formed into approximately the same shape as that of the grooves 9 and 17 to be formed.

For example, when the groove 9 extends in an arc shape (when the groove extends approximately in the X-axis direction because of an arc shape having a large curvature radius), the guide part 59 is formed to extend in an arc shape just like the groove 9.

Here, a more detailed description is given of the blade 35, the blade holder 43, the leather retainer (small piece of leather material retainer) 45 and the guide member 55.

FIGS. 8 (*a*) to 8 (*c*) are views showing a schematic configuration of the blade 35 and the blade holder 43 holding the blade 35. FIG. 8 (*a*) is a front view, FIG. 8 (*b*) is a cross-sectional view taken along the line VIIIB-VIIIB of FIG. 8 (*a*), and FIG. 8 (*c*) is a view seen from the arrow VIIIC in FIG. 8 (*b*). Note that the grooves 9 and 17 are formed by the blade 35 and blade holder 43 moving leftward in FIG. 8 (*b*).

The blade 35 is formed into a flat thin plate having a triangular sharp tip (lower end), and a sloped portion of the tip serves as a blade part.

The blade holder 43 integrally holds the blade 35 with the upper part of the blade 35 inserted thereinto. In the lower part of the blade holder 43, i.e., the center in a radial direction of the blade holder 43, a notch 63 is formed. The pair of rollers 53A and 53B are provided inside the notch 63. The rollers 53A and 53B are provided in the blade holder 43 so as to rotate around the axis C1 extending in the horizontal direction.

The both sides in the thickness direction of the blade 35 held by the blade holder 43 are orthogonal to the axis C1, and the blade 35 held by the blade holder 43 extends downward between the pair of rollers 53A and 53B.

A distance (dimension) h between the tip of the blade 35 held by the blade holder 43 and the lower ends of the pair of rollers 53A and 53B can be easily adjusted to an appropriate value by loosening a fixation screw (not shown) and then turning an adjustable screw (not shown).

Figure 9:
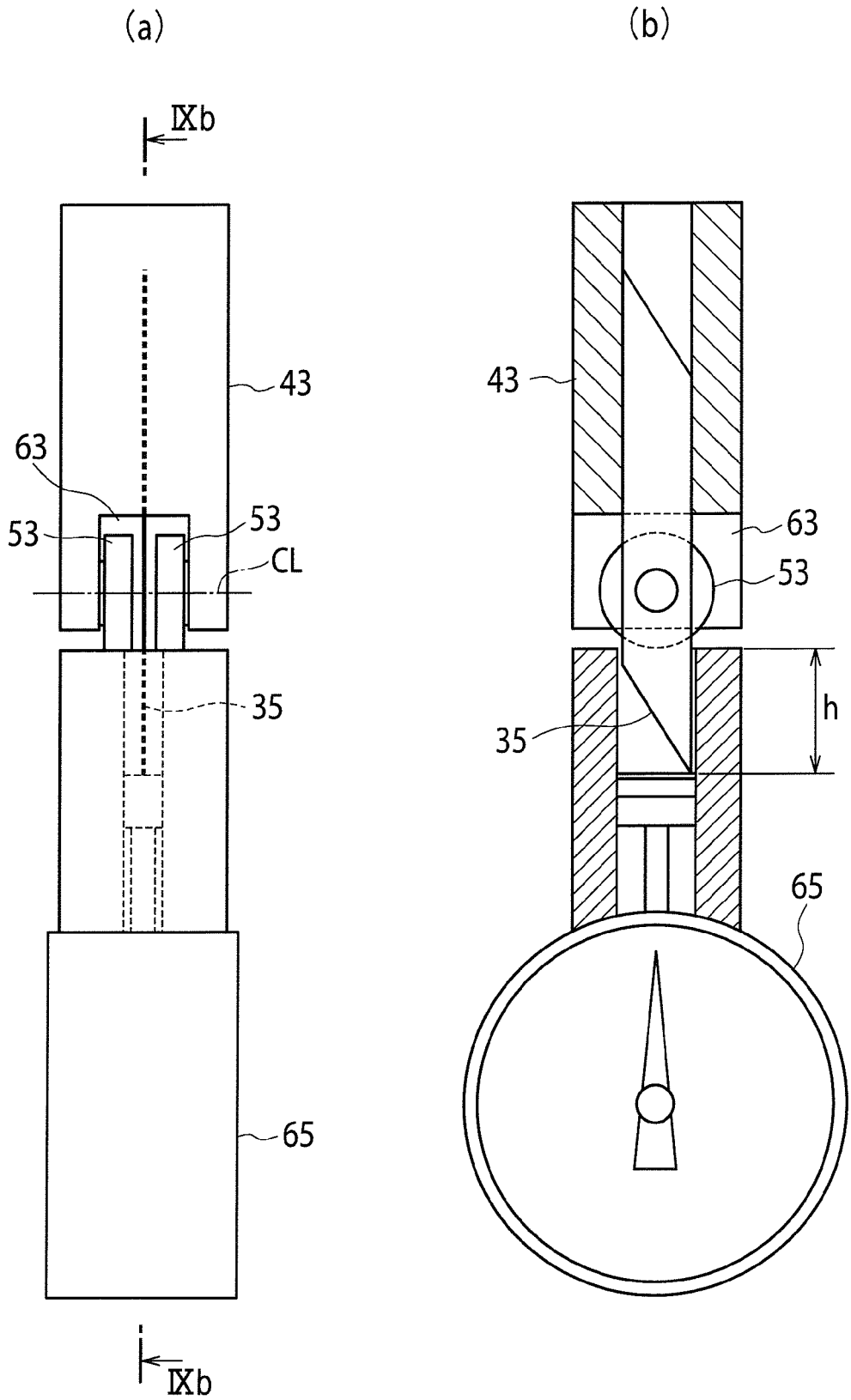
FIGS. 9 (*a*) and 9 (*b*) are views showing adjustment of a distance between a tip of the blade held by the blade holder and lower ends of a pair of rollers.

The distance h is adjusted by using a dial gauge 65 as shown in, for example, FIG. 9 (showing adjustment of a distance between the tip of the blade 35 held by the blade holder 43 and the lower ends of the pair of rollers 53). When the distance h reaches a target value, the fixation screw is fastened to maintain the distance h at the target value.

As described above, the leather retainer 45 includes the first leather retainer 45A and the second leather retainer 45B. The respective leather retainers 45A and 45B are integrally provided on the base body 37 while being located side by side in the Y-axis direction at appropriate positions on the upper surface of the base body 37 (see FIG. 5).

As shown in FIGS. 6 (*a*) and 6 (*b*), the first leather retainer 45A includes a rectangular plate-like base material 67, a rectangular loop-like (frame-shaped) frame body 69, and a pair of spacers 71A and 71B each having an elongated rectangular plate shape.

The frame body 69 is formed into a square shape in a planar view, and an outer peripheral shape thereof is approximately the same as that of the base material 67. The frame body 69 is integrally provided on one surface (upper surface) in the thickness direction of the base material 67 so as to have its outer periphery overlap with the outer periphery of the base material 67.

The rectangular sheet-like small piece of leather material 11 is integrally placed on the first leather retainer 45A with the grain side, for example, being in surface contact with the upper surface of the base material 67, and with the periphery thereof being in contact with or slightly away from the inner periphery of the frame body 69 integrally provided on the base material 67.

Note that the base material 67 has a number of small holes (not shown) provided therein, and holds the small piece of leather material 11 in the form of flat sheet by vacuum contact using the small holes.

Moreover, the base material 67 also has a number of (e.g., four) cylindrical positioning pins 73 provided therein. The small piece of leather material 11 is positioned relative to the first leather retainer 45A in an in-plane direction of the grain side or floor surface of the small piece of leather material 11 by inserting the positioning pins 73 into the through-holes provided in the small piece of leather material 11.

Here, the positioning pins 73 may be configured to be detachable from the base material 67. The positioning of the small piece of leather material 11 relative to the base material 67 may be performed by placing the small piece of leather material 11 on the base material 67 and then setting the positioning pins 73 on the base material 67 by inserting the positioning pins 73 into the through-holes 23 of the small piece of leather material 11 and through-holes of the base material 67.

The spacers 71A and 71B are integrally provided at both ends of the frame body 69 in the Y-axis direction on the upper surface of the frame body 69 integrally provided on the base material 67. The guide member 55A is formed into a rectangular flat plate. Moreover, the guide member 55A is integrally provided on the base material 67 (the pair of spacers 71A and 71B) so as to bridge across the pair of spacers 71A and 71B on the spacers and in such a manner that the thickness direction of the base material 67 and the thickness direction of the guide member 55A coincide with each other. Note that a space is formed between the base material 67 and the guide member 55A, and the small piece of leather material 11 is placed in the space.

In the guide member 55A, through-holes 75 are provided, through which the blade 35 passes during formation of the grooves 9 and 17 in the small piece of leather material 11. Note that lines L1 shown inside the through-holes 75 shown in FIG. 6 (*a*) are traces of the blade 35 in formation of the grooves 9 and 17 in the small piece of leather material 11.

Both sides of each of the through-holes 75 serve as the guide part 59. The rollers 53A and 53B are placed on the guide part 59, and the blade 35 (the blade holder 43) is positioned in the Z-axis direction (vertical direction). The rollers 53A and 53B form a rolling pair relative to the guide part 59 (guide member 55A) and the blade 35 (the blade holder 43) is moved arbitrarily in the Y-axis direction or X-axis direction. Thus, the grooves 9 and 17 are formed.

As shown in FIGS. 7 (*a*) and 7 (*b*), the second leather retainer 45B also has the same configuration as that of the first leather retainer 45A, including a base material 67, a frame body 69 and a pair of spacers 71A and 71B. As in the case of the first leather retainer 45A, the second leather retainer 45B also has the guide member 55B provided therein. Moreover, as in the case of the guide member 55A, through-holes 75 are formed also in the guide member 55B. FIG. 7 (*a*) omits the representation of the guide part 59.

Note that, the vertical portions 27 and 29 of the groove 9, the groove 17C of the test piece 15C, and the groove 17D of the test piece 15D are formed when the small piece of leather material 11 is placed on the first leather retainer 45A. Meanwhile, the horizontal portion 25 of the groove 9, the groove 17A of the test piece 15A, and the groove 17B of the test piece 15B are formed when the small piece of leather material 11 is placed on the second leather retainer 45B.

Moreover, as can be seen from FIGS. 6 and 7, the grooves 9 and 17 are formed in the small piece of leather material 11 by moving the blade 35 (the blade holder 43) mostly in the Y-axis direction. In other words, the grooves 9 and 17 are formed with a movement distance in the X-axis direction set to be smaller than a movement distance in the Y-axis direction. Accordingly, it is only necessary to mostly move the Y-axis movable body 41 having a small mass. Thus, the grooves 9 and 17 can be quickly and accurately formed with small power.

Figure 11:
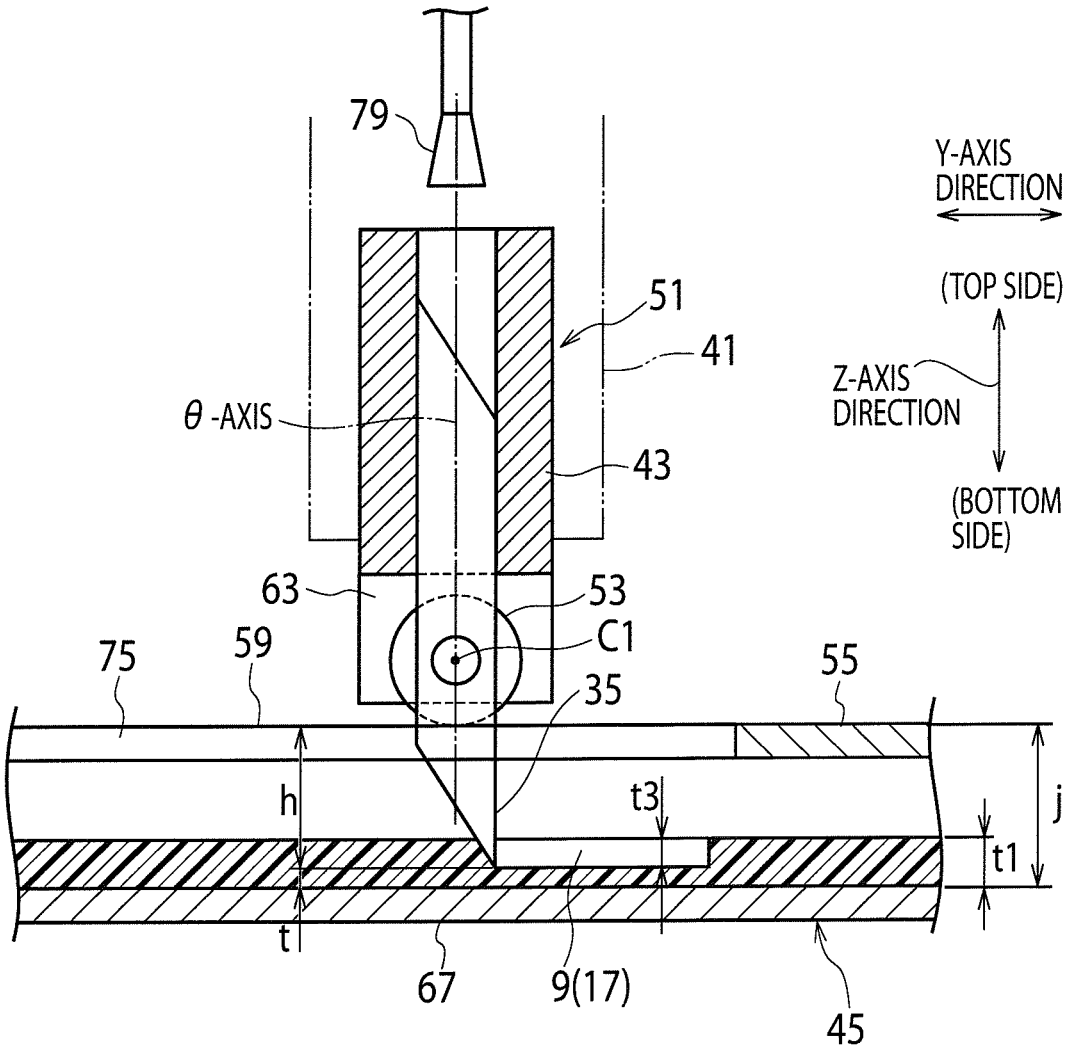
FIG. 11 is a view showing a state during formation of grooves in the small piece of leather material.

To obtain an accurate thickness t of the remnant of the small piece of leather material 11 having the grooves 9 and 17 formed therein, it is required to accurately obtain the distance (dimension) h shown in FIG. 9 (*b*) and to accurately obtain a distance j between the guide part 59 (the upper surface of the guide member 55) and the surface of the leather retainer 45 installed on the base body 37 (the upper surface of the base material 67) for mounting the small piece of leather material 11 (see FIG. 11).

Figure 10:
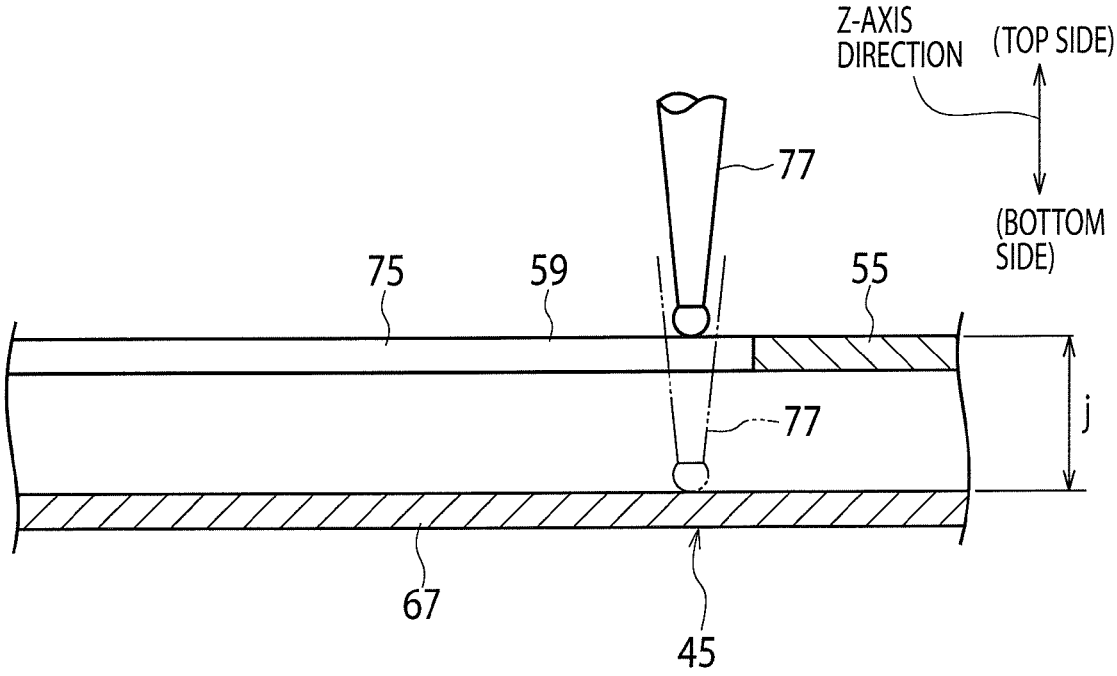
FIG. 10 is a view showing distance measuring means, provided in the leather groove forming apparatus, for measuring a distance between an upper surface of a guide member and an upper surface of the leather retainer.

To realize this, distance measuring means for measuring the distance j may be provided. The distance measuring means is configured by providing a Z-axis movable body (not shown) on the Y-axis movable body 41 and then providing a touch probe 77 (see FIG. 10) integrally with the Z-axis movable body. The Z-axis movable body is provided on the Y-axis movable body 41 by means of, for example, a linear guide bearing and is movable in the Z-axis direction. Moreover, the Z-axis movable body can be freely moved and positioned in the Z-axis direction by an actuator such as a linear motor, and the position thereof relative to the Y-axis movable body 41 is detected by an encoder (not shown).

Here, with reference to FIG. 11, a more detailed description is given of the state where the grooves 9 and 17 are formed in the small piece of leather material 11 by the blade 35.

The thickness t of the remnant of the small piece of leather material 11 in the portion where the grooves 9 and 17 are formed takes a constant value obtained by subtracting the dimension h from the distance j. Here, if the thickness t1 of the small piece of leather material 11 is constant, the depth t3 of the grooves 9 and 17 is constant. Note that when the grooves 9 and 17 are formed in the small piece of leather material 11, the blade 35 (the blade holder 43) is moved leftward from the right-hand side of FIG. 11.

In the leather groove forming apparatus 33, a bound sensor 79 may be provided to allow the remnant to have a constant thickness t by placing the rollers 53A and 53B on the guide member 55. The bound sensor 79 is provided integrally with the Y-axis movable body 41, for example. When the bound of the blade holder 43 is detected by the bound sensor 79 (when the rollers 53 come away from the guide member 55), the operation of the leather groove forming apparatus 33 is stopped, for example, to give an alarm using a display device (not shown).

Moreover, although the thickness t of the remnant of the small piece of leather material 11 is constant, the thickness t of the remnant may be changed appropriately depending on the specifications of the leather 5 by use of the guide part 59 formed with a sloped or curved surface instead of the flat level surface.

Furthermore, the leather retainer 45 may be omitted and the small piece of leather material 11 (the leather 5) may be held directly by the base body 37. In this case, the small piece of leather material 11 is held by the base body 37 in the flat sheet state with the grain side in the thickness direction of the small piece of leather material 11 being in surface contact with the flat upper surface of the base body 37. Moreover, the guide member 55 is integrally provided in the base body 37.

Moreover, a free bearing (including a base and a spherical body rotatably provided on the base) may be used instead of the rollers 53 so that the spherical body (ball) of the free bearing is placed on the guide part 59 to position the blade holder 43 in the Z-axis direction.

Here, operations of the leather groove forming apparatus 33 and the like are described.

First, in an initial state, the respective leather retainers 45A and 45B having the guide members 55 (55A and 55B) mounted thereon are placed on the base body 37, the blade holder 43 having the blade 35 mounted thereon is lifted by an actuator such as a solenoid (not shown), and the small piece of leather material 11 is placed on the leather retainer 45A.

When an operator presses a start switch (not shown) of the leather groove forming apparatus 33 in the initial state described above, the leather groove forming apparatus 33 starts its operation to form the vertical portions 27 and 29 of the groove 9 and the grooves 17C and 17D under the control of the controller 57 based on an operation program previously stored in a memory of the controller 57.

More specifically, first, the X-axis movable body 39 and the Y-axis movable body 41 are moved appropriately to position the blade 35 immediately above a spot where formation of the grooves 9 and 17 is started, and the blade holder 43 is lowered by the solenoid described above to place the rollers 53 on the guide member 55A (the guide part 59). Thus, the blade 35 pierces the small piece of leather material 11 through the through-hole 75. Thereafter, the X-axis movable body 39 and the Y-axis movable body 41 are moved appropriately with the rollers 53 kept placed on the guide member 55A so that the remnant of the small piece of leather material 11 shown in FIG. 11 has an approximately constant thickness t, thereby forming the groove 17C. Subsequently, the operations of lifting and lowering the blade holder 43 and of moving the X-axis movable body 39 and the Y-axis movable body 41 are appropriately repeated to form the groove 17D and the vertical portions 27 and 29 of the groove 9.

Here, in the vertical direction (vertical direction) in FIG. 4 (*a*), the vertical portion 27 of the groove 9 and the groove 17C are located at approximately the same position. More specifically, the groove 17C is located approximately on an extension of the vertical portion 27. Likewise, the groove 17D is located approximately on an extension of the vertical portion 29. Thus, a value close to the strength of the groove 9 (the vertical portions 27 and 29) in the product (leather 5) can be measured by substituting the test pieces 15C and 15D.

Note that the blade holder 43 is provided on the Y-axis movable body 41 rotatably around a θ-axis extending in the Z-axis direction through the center of the blade holder 43, for example. The blade holder 43 is configured to rotate in accordance with the curve of the groove 9 so that the both sides in the thickness direction of the blade 35 approximately coincide with the longitudinal direction of the grooves 9 and 17. Moreover, the blade holder 43 is energized around the θ-axis by an elastic body such as a spring. To be more specific, in a state where no rotary torque is applied to the blade holder 43, the thickness direction of the blade 35 held by the blade holder 43 approximately coincides with the Y-axis direction.

After the formation of the vertical portions 27 and 29 of the groove 9 and the grooves 17C and 17D, the operator removes the small piece of leather material 11 from the leather retainer 45A, and places the small piece of leather material 11 on the leather retainer 45B after rotating the small piece of leather material 11 by 90°.

After the small piece of leather material 11 is placed on the leather retainer 45B, the horizontal portion 25 of the groove 9 and the grooves 17A and 17B are formed in the same manner as the formation of the vertical portions 27 and 29 of the groove 9 and the grooves 17C and 17D, under the control of the controller 57 (see FIG. 4 (*b*)).

Here, in the vertical direction (vertical direction) in FIG. 4 (*b*), the horizontal portion 25 of the groove 9 and the grooves 17A and 17B are located at approximately the same position. More specifically, the grooves 17A and 17B are located approximately on an extension of the horizontal portion 25. Thus, a value close to the strength of the groove 9 (the horizontal portion 25) in the product (leather 5) can be measured by substituting the test pieces 15A and 15B.

As shown in FIG. 3, the small piece of leather material 11 having the grooves 9 and 17 formed therein is punched using the die to produce the leather 5 and test pieces 15 having the grooves 9 and 17 formed therein.

In the leather groove forming apparatus 33, the blade 35 (the blade holder 43) is positioned in the height direction in such a mechanical manner that the rollers 53 provided in the blade holder 43 is placed on the guide member 55. Thus, the thickness t of the remnant of the leather 5 (small piece of leather material 11) in the portions where the grooves 9 and 17 are formed can be accurately obtained without complication of the configuration of the apparatus or operation program.

More specifically, accurate positioning of the blade 35 in the height direction can be performed regardless of an increase in beam elastic deformation of the X-axis movable body 39 having the elongated shape, very slight rattling of the X-axis movable body 39 and the Y-axis movable body 41, and very slight rattling of the X-axis movable body 39 and the Y-axis movable body 41 due to repeated use over the years, and without performing positional correction (correction using a program) in the height direction of the blade 35 (the blade holder 43). Furthermore, the apparatus can be prevented from growing in size, and the thickness t of the remnant of the leather 5 (the remaining thickness of the leather in the groove portion) in the portions where the grooves 9 and 17 are formed (portions where the grooves are formed) can be accurately obtained.

Setting the thickness t of the remnant of the leather 5 makes it possible to prevent a line indicating the position of the groove 9 from appearing on the surface (grain side) of the leather 5, to prevent degradation in a sense of high quality created by the leather 5, and to allow the horn pad 1 and the instrument panel (the base material 3) to surely break at the expected break line when the airbag is inflated.

Moreover, in the leather groove forming apparatus 33, the leather retainer 45 and the guide member 55 are provided in two separate pieces, respectively. Thus, the thickness t of the remnant of the leather 5 in the portion where the groove 9 is formed can be accurately obtained also in the intersection portion of the groove 9.

More specifically, when the leather retainer and the guide member are not provided in two separate pieces, a through-hole (corresponding to the through-hole 75 of the leather retainer 45B shown in FIG. 7 (*a*)) 75*a* indicated by a dashed line in FIG. 6 (*a*) needs to be formed in addition to the through-hole 75 shown in FIG. 6 (*a*). If the through-hole 75*a* is formed in the guide member 55A shown in FIG. 6 (*a*), a part of the guide part 59 is lost by the through-hole 75*a*. This causes temporal disappearance of the guide part 59 on which the rollers 53 are placed in the middle of formation of the vertical portion 27 of the groove 9. As a result, the thickness t of the remnant of the leather 5 can no longer be accurately obtained. However, by providing the leather retainer and the guide member in two separate pieces, the thickness t of the remnant of the leather 5 can be accurately obtained without any missing part in the intersection portion of the groove 9.

Moreover, in the leather groove forming apparatus 33, the one end in the longitudinal direction of the horizontal portion 25 slightly protrudes outward from the first vertical portion 27 and the other end in the longitudinal direction of the horizontal portion 25 slightly protrudes outward from the second vertical portion 29. This allows the horizontal portion 25 and the vertical portions 27 and 29 to surely intersect with each other, and also allows the horn pad 1 and the instrument panel (the base material 3) to more surely break at the expected break line when the airbag is inflated.

In the formation of the grooves 9 and 17, the blade holder 43 may be forcibly rotated around the θ-axis by use of an actuator (θ-axis drive means) such as a servo motor, based on an operation program stored in the memory of the controller 57.

Figure 12:
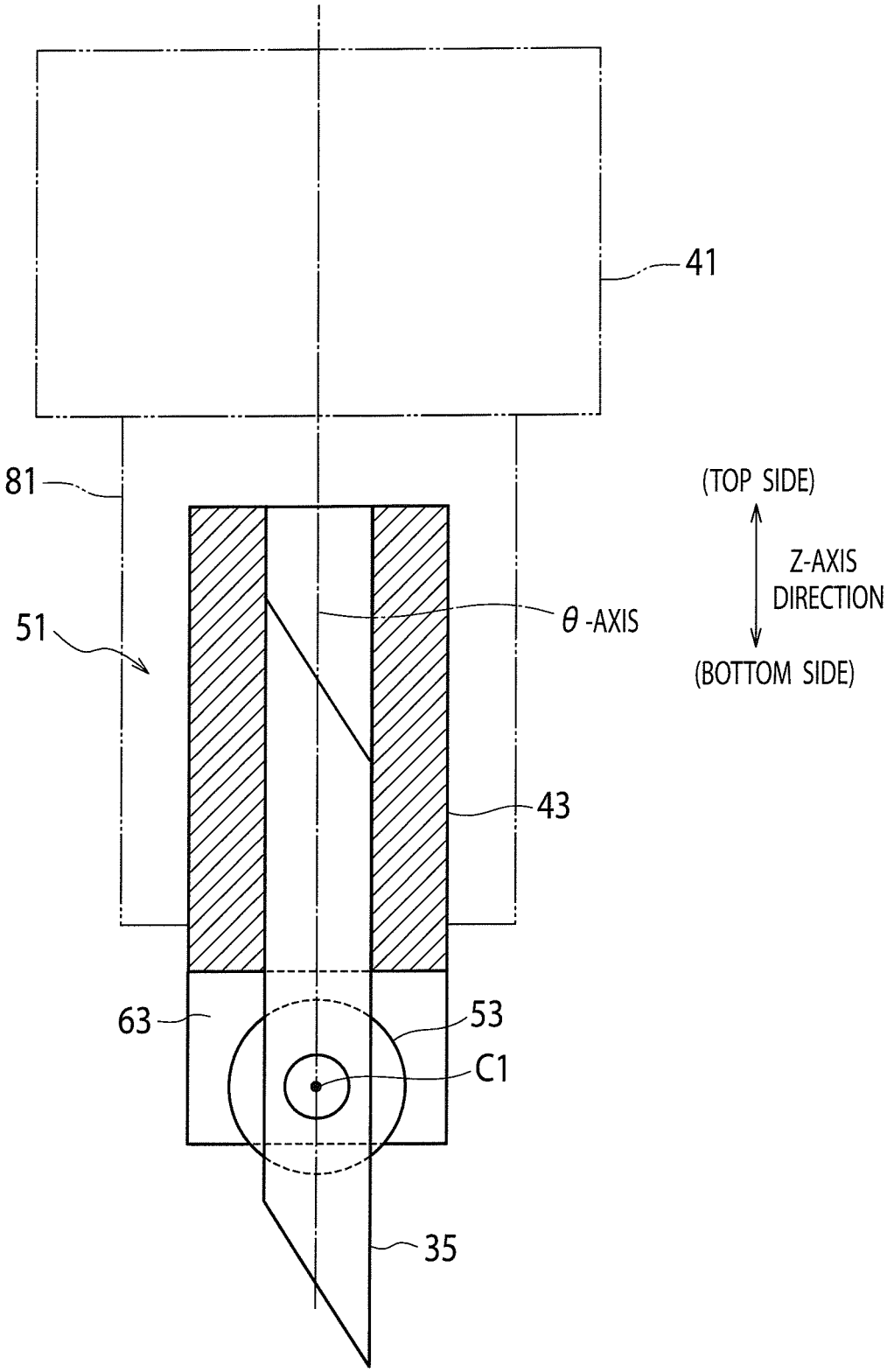
FIG. 12 is a view showing a leather groove forming apparatus provided with a θ-axis rotator.

To be more specific, a configuration may be adopted, as shown in FIG. 12, in which a θ-axis rotator 81 is provided on the Y-axis movable body 41 rotatably around the θ-axis, the θ-axis rotator 81 is rotated using the actuator such as the servo motor, and the blade holder 43 is provided on the θ-axis rotator 81 movably in the Z-axis direction.

Moreover, when the X-axis movable body 39 and the Y-axis movable body 41 are moved in accordance with the shape of the groove 9 to be formed, the X-axis drive unit 47, the Y-axis drive unit 49 and the θ-axis drive means may be controlled by the controller 57 so that an expansion direction of the both sides in the thickness direction of the thin plate-like blade 35 approximately coincides with the extending direction of the groove 9.

Note that the leather groove forming apparatus 33 is an example of a leather groove forming apparatus including: a blade holder holding a blade for forming a groove in one surface in a thickness direction of a held leather held in a flat sheet state by a leather retainer; blade holder moving unit for moving the blade holder in an in-plane direction of one surface in the thickness direction of the held leather; and blade holder positioning unit for positioning the blade holder in a direction intersecting with the in-plane direction (e.g., a groove depth direction that is orthogonal to the in-plane direction; a Z-axis direction) with a part of the blade holder placed on a guide member in formation of the groove in the one surface in the thickness direction of the held leather by moving the blade holder using the blade holder moving unit.

The entire contents of Japanese Patent Application No. 2009-227647 (filed on Sep. 30, 2009) are incorporated herein by reference.

The present invention is not limited to the above description of the embodiments of the invention, but can be carried out in various other forms with any appropriate modification.

The invention claimed is:

1. A leather groove forming apparatus, comprising:

a blade holder holding a blade for forming a groove in one surface in a thickness direction of a held leather held in a flat sheet state;

a blade holder moving unit to move the blade holder in an in-plane direction of the one surface in the thickness direction of the held leather; and a blade holder positioning unit to position the blade holder in a direction intersecting with the in-plane direction with the blade holder placed on a guide member during formation of the groove in the held leather by moving the blade holder using the blade holder moving unit, wherein a roller of the blade holder is in contact with the guide member during formation of the groove, so that a position of the blade holder in a vertical direction is determined.

2. The leather groove forming apparatus according to claim 1, wherein the groove includes a first portion and a second portion intersecting with the first portion or a second portion forming a "T"-shaped portion with the first portion, and the guide member includes a first guide member on which the roller of the blade holder is placed in formation of the first portion, and a second guide member on which the roller of the blade holder is placed in formation of the second portion.

3. The leather groove forming apparatus according to claim 1, wherein the groove is formed in an "H" shape, including an approximately horizontally extending horizontal portion, an approximately vertically extending first vertical portion having an intermediate portion in its longitudinal direction intersect with one end in a longitudinal direction of the horizontal portion, and an approximately vertically extending second vertical portion having an intermediate portion in its longitudinal direction intersect with the other end in the longitudinal direction of the horizontal portion, the one end in the longitudinal direction of the horizontal portion slightly protrudes outward from the first vertical portion, the other end in the longitudinal direction of the horizontal portion slightly protrudes outward from the second vertical portion, and the guide member includes a first guide member on which a roller of the blade holder is placed in formation of the vertical portions, and a second guide member on which the roller of the blade holder is placed in formation of the horizontal portion.

4. A leather groove forming apparatus for forming a groove in one surface in a thickness direction of leather, comprising:

a base body for integrally holding the leather with a leather retainer, the leather being integrally held by the leather retainer in a flat sheet state with the other surface in the thickness direction being in surface contact with a planar holding surface of the leather retainer;

an X-axis movable body provided on the base body movably in an X-axis direction that is one horizontal direction;

a Y-axis movable body provided on the X-axis movable body movably in a Y-axis direction that is another horizontal direction orthogonal to the X-axis direction;

a blade holder provided on the Y-axis movable body movably in a vertical direction and configured to hold a blade for forming a groove in the held leather;

X-axis drive unit to drive the X-axis movable body in the X-axis direction;

Y-axis drive unit to drive the Y-axis movable body in the Y-axis direction; and a roller rotatably provided in the blade holder and configured to position the blade holder in a vertical direction with an outer periphery of the roller placed on a guide member provided in the leather retainer.

5. The leather groove forming apparatus according to claim 4, wherein the groove includes a first portion and a second portion intersecting with the first portion or a second portion forming a "T"-shaped portion with the first portion, and the guide member includes a first guide member on which a roller of the blade holder is placed in formation of the first portion, and a second guide member on which the roller of the blade holder is placed in formation of the second portion.

6. The leather groove forming apparatus according to claim 4, wherein the groove is formed in an "H" shape, including an approximately horizontally extending horizontal portion, an approximately vertically extending first vertical portion having an intermediate portion in its longitudinal direction intersect with one end in a longitudinal direction of the horizontal portion, and an approximately vertically extending second vertical portion having an intermediate portion in its longitudinal direction intersect with the other end in the longitudinal direction of the horizontal portion, the one end in the longitudinal direction of the horizontal portion slightly protrudes outward from the first vertical portion, the other end in the longitudinal direction of the horizontal portion slightly protrudes outward from the second vertical portion, and the guide member includes a first guide member on which a roller of the blade holder is placed in formation of the vertical portions, and a second guide member on which the roller of the blade holder is placed in formation of the horizontal portion.

7. A leather groove forming method, comprising:

a leather holding step of holding leather, by a blade holder, in a flat sheet state; and a groove forming step of forming a groove in one surface in a thickness direction of the leather, held in the flat sheet state in the leather holding step, with a blade for forming a groove in the leather or a blade holder holding the blade placed on a guide member so that a remnant of the leather where the groove is formed in the leather has an approximately constant thickness wherein the blade holder is in contact with the guide member during forming the groove.

* * * * *